US005433047A

United States Patent [19]

Wallace et al.

[11] Patent Number: 5,433,047

[45] Date of Patent: Jul. 18, 1995

[54] INTERLOCKING AND INSULATED BUILDING PANS

[75] Inventors: William T. Wallace, 600 S. Hoyne Ave., Chicago, Ill. 60612; Paul Depondt, Le Jardin Tropical 3, Rue Des Chenes-Pourpres, 95034 Cergy-Pontoise Cedex, France

[73] Assignees: Pab Est, France; William T. Wallace, Chicago, Ill.; Paul Depondt, France

[21] Appl. No.: 240,447

[22] Filed: May 10, 1994

[51] Int. Cl.[6] ..... E06B 7/06

[52] U.S. Cl. ..... 52/284; 52/275; 52/270

[58] Field of Search ..... 52/241, 242, 243, 266, 52/270, 271, 275, 284, 285.1, 285.3, 286, 741.1, 745.19, 404.1

[56] References Cited

U.S. PATENT DOCUMENTS

| | | | |
|---|---|---|---|
| 945,682 | 1/1910 | Berg . | |
| 950,832 | 3/1910 | Banning . | |
| 1,925,417 | 9/1933 | Swank | 52/284 |
| 3,205,632 | 9/1965 | McCormick . | |
| 3,234,700 | 2/1966 | Creveling | 52/284 |
| 3,287,868 | 11/1966 | Becker . | |
| 3,397,496 | 8/1968 | Sohns | 52/284 X |
| 3,465,488 | 9/1969 | Miller . | |
| 3,481,094 | 12/1969 | Taylor . | |
| 3,618,281 | 11/1971 | Hill et al. | 52/275 X |
| 4,104,837 | 8/1978 | Naito | 52/241 X |
| 4,505,082 | 3/1985 | Schmitz . | |
| 4,641,468 | 2/1987 | Slater . | |
| 4,796,396 | 1/1989 | Menchetti | 52/241 X |
| 5,020,290 | 6/1991 | Hajjar | 52/241 X |
| 5,274,975 | 1/1994 | Haag | 52/241 X |

*Primary Examiner*—Carl D. Friedman
*Assistant Examiner*—Creighton Smith
*Attorney, Agent, or Firm*—Richard C. Litman

[57] ABSTRACT

The present invention is an insulated modular wall system for quickly and efficiently constructing buildings of one or more stories. Included in this modular wall system is a plurality of building pans, each having a pair of flanges for interlocking adjacent building pans. Some of these flanges are configured to compensate for dimensional variations that are inherent in each of the building pans. If not compensated for, these dimensional variations can result in excessive stress when a plurality of adjacent building pans are interlocked. Included in the invention is a unique method for supporting convention floor boards, and a unique arrangement for creating a gap for electrical wires and the like.

25 Claims, 6 Drawing Sheets

INTERLOCKING AND INSULATED BUILDING PANS

BACKGROUND OF THE INVENTION

1. Field of the Invention

The present invention relates to a modular wall system for quickly and efficiently constructing buildings of one or more stories. More specifically, the invention relates to a modular wall system having a plurality of interlocking and insulated building pans.

2. Description of the Prior Art

Wall structures formed from the attachment of a plurality of adjacent panel components are well known in the prior art. U.S. Pat. No. 945,682 issued to Lars J. Berg on Jan. 4, 1910, discloses metallic sheathing primarily for use in covering the side walls of railway passenger cars. This sheathing comprises a plurality of strips or sections, each of which have a pair of opposite edge walls. One of these edge walls is configured to have a convex shape, while the other edge wall is configured to have a concave shape. The sheathing is formed by arranging a plurality of panels so that the convex edge wall of each panel neighbors the concave edge wall adjacent panels. These concave and convex edge walls are then interlocked until the desired length of sheathing is obtained.

A metallic sheathing is also shown in U.S. Pat. No. 950,832 issued to Samuel W. Banning on Mar. 1, 1910. As with the Berg patent, the metallic sheathing of this invention comprises a plurality of interlocking sections. These panels each have a pair of ends, both of which terminate in an attachment flange. The attachment flange of one end extends toward the center of the section, while the attachment flange of the other end extends away from the center of the section. The attachment flanges of adjacent sections mate with each other to connect neighboring sections. One of the flanges has a recessed portion that creates a groove between the flanges. This recessed portion receives the end of a bolt, or other article, that affixes an exterior wall surface to the sheathing.

Another interlocking panel system incorporating mating flanges with a gap therebetween is U.S. Pat. No. 3,481,094 issued to Donald M. Taylor on Dec. 2, 1969. This invention shows an interlocking rib panel having upstanding flanges extending from opposed edges. Each of these flanges have a different configuration, such than when one flange of one panel is interlocked with a flange of a different panel, a space is provided between the interlocking flanges. Sealant is placed within this space to assure that the connection of the panels is waterproof.

Other modular wall structures include U.S. Pat. No. 3,205,632 issued to John E. McCormick on Sep. 14, 1965. This patent illustrates a wall panel structure formed from a plurality of interlocking components. The top of the wall panel structure is crowned by a cap in the form of a channel. This cap has a main body which sits upon the top of the wall panel structure. Extending from the main body is a pair of extensions, each of which engage a different face of the wall panel structure.

Similar crowning caps are shown in U.S. Pat. No. 3,287,868 issued to Raymond F. Becker on Nov. 29, 1966, and U.S. Pat. No. 3,465,488 issued to Peter H. Miller on Sep. 9, 1969. The Becker patent depicts a multi-component wall structure having a top cap for placement on the upper surface of a plurality of interlocked components. Each of these components includes a pair of hook portions, one of which points toward the center of the component, and one of which points away from the center of the component. Hook portions of adjacent components mate with each other to interlock the components.

The Miller patent discloses a dry wall structure constructed of suitably spaced upright studs secured to sheet metal floor runners anchored to the floor. The studs, which may include conduits for wires and pipes, serve as supports for a plurality of wall panels. A sheet metal channelled cap extends along the upper length of the wall.

Still another modular wall system is illustrated in U.S. Pat. No. 4,505,082 issued to Peter Schmitz on Mar. 19, 1985. This patent shows a structural panel having spaced surfaces with a foam core material placed therebetween. The surfaces are both formed from a plurality of interlocking sheet metal plates, each of which have bent edges for mating with the bend edges of neighboring plates.

Foam insulating material is also shown in U.S. Pat. No. 4,641,468 issued to Jack Slater on Feb. 10, 1987, which shows a panel structure comprising a plurality of elongated slabs of rigid structural grade polystyrene foam insulating material. Each slab includes a pair of recesses disposed upon each of its longitudinal side edges, with each pair of recesses forming a tongue therebetween. The slabs are disposed in side by side coplanar relationship with the tongues of respective slabs being disponed in opposed abutting relationship. A rigid framing member is then placed within the recesses, and serves to sandwich the abutting tongues of adjacent slabs. Perimeter framing strips are then secured to the top and the bottom of the panel structure.

None of the above inventions and patents, taken either singly or in combination, is seen to describe the instant invention as claimed.

SUMMARY OF THE INVENTION

The present invention is a modular wall system for quickly and efficiently constructing buildings of one or more stories. Included in this modular wall system is a plurality of building pans, each having a main body with a pair of oppositely spaced, substantially J-shaped flanges. A foam insulating material is placed upon the main body, and the J-shaped flanges of adjacent pans are arranged to engage and interlock with each other. Each pair of interlocked flanges forms a stud upon which one or more spacers may be secured. These spacers create a gap between the insulating foam material and a subsequently attached interior wall finish. Such a gap is utilized for the placement of electrical wires and the like.

To compensate for inherent dimensional variations, one or more of the flanges could be configured as a dimension compensating, substantially L-shaped flange. This type of flange is similar to the J-shaped flanges, except that it does not include the portion of the flange that effects the interlocking. This portion is eliminated to permit the flanges to slip relative to each other so wall panels can accurately interface. The interlocking portion is attached to the L-shaped flange to interlock the mating flanges when they have settled relative to each other.

A plurality of interlocked pans form a rigid wall that may be erected upon either a foundation wall or upon the top plate of a substantially C-shaped bearing channel. When the rigid wall is erected upon the bearing channel, conventional floor joists are supported by the bottom plate of the bearing channel. A portion of the top plate extends outward from the rigid wall to support conventional floor boards. The entire assembly comprising the bearing channel and the rigid wall is utilized to construct a single story of a building. To construct a multi-story building, this entire assembly is vertically repeated as necessary.

Accordingly, it is a principal object of the invention to provide a novel modular wall system for quickly and efficiently constructing buildings of one or more stories.

It is another object of the invention to provide a novel modular wall system formed from a plurality of interlocked and insulating building pans.

It is a further object of the invention to provide a novel modular wall system that is not detrimentally affected by dimensional variations that are inherent in each of the interlocked pans.

Still another object of the invention is to provide a novel modular wall system having a gap for electrical wires and the like.

Still another object of the invention is to provide a novel modular wall system having improved apparatus for supporting conventional floor boards.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a modular wall structure that lends itself to the economical erection of all buildings, whether commercial or residential. The central components in this modular wall structure are interlocking building pans, shown in FIGS. 1 through 8. These building pans are utilized in varying combinations with each other to form a rigid wall. Each of the building pans are constructed from galvanized steel with a gauge and depth fabricated in accord with the design load requirements of each building.

Figure 1:
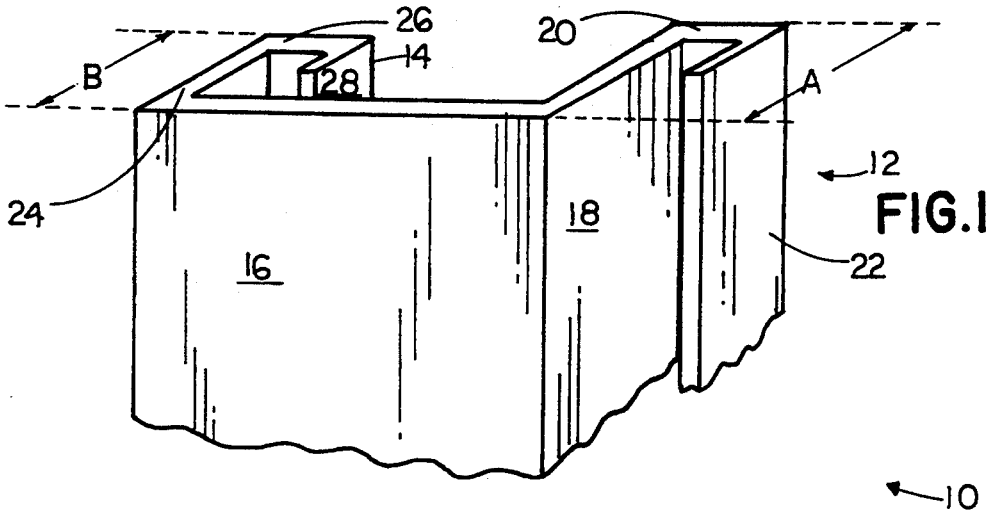
FIG. 1 is an enlarged scale, partial perspective view of a typical wall panel of the present invention.
Figure 2:
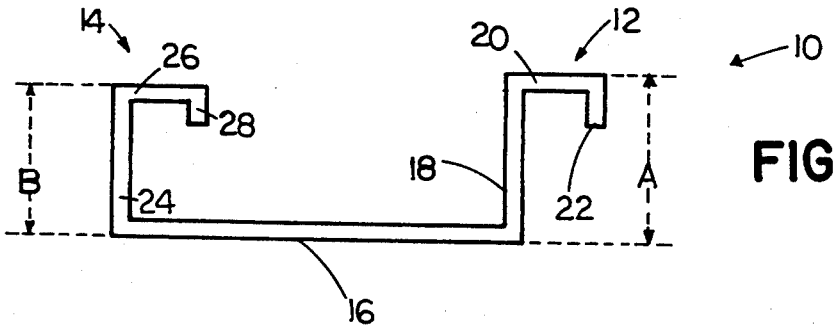
FIG. 2 is an enlarged scale, top plan view of the typical wall panel shown in FIG. 1.
Figure 11:
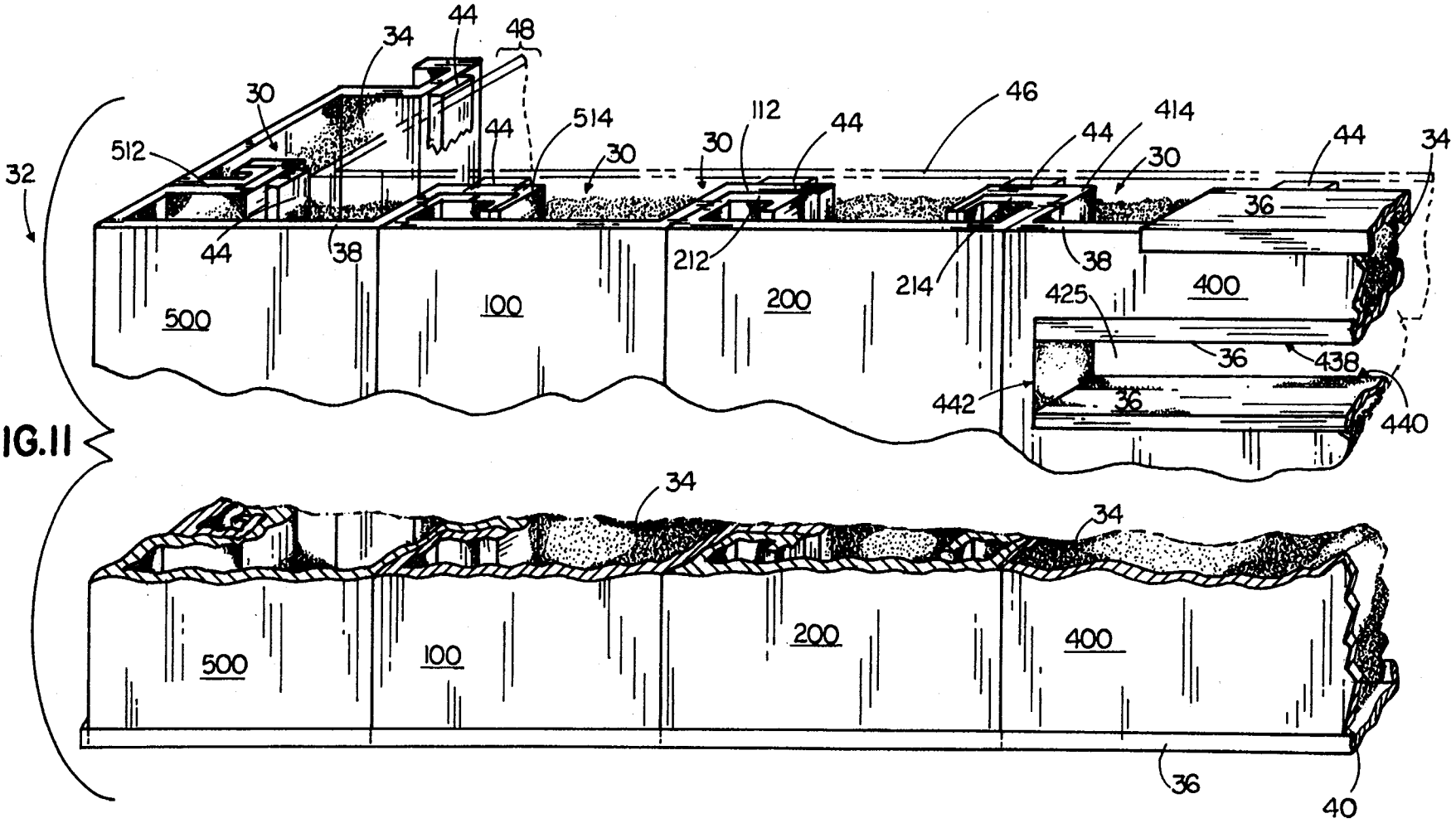
FIG. 11 is a partial, perspective view of the modular wall system of the present invention.

A typical building pan 10 is shown in FIGS. 1 and 2. This building pan 10 includes a first side element or flange 12 and a second side element or flange 14, each of which are arranged on opposing sides of a main body 16. First flange 12 includes a base 18, a transverse portion 20, and a return portion 22. This configuration forms a substantially J-shaped flange 12 which faces outward from main body 16. Second flange 14 includes a base 24, a transverse portion 26, and a return portion 28, but is configured to face inward toward main body 16. The length A of base 18 of flange 12 is greater than the length B of base 24 of flange 14. This permits each of the flanges 12,14 to mate with and interlock with neighboring flanges of adjacent building pans. Flange 12 engages over and interlocks with an inwardly facing flange of an adjacent building pan, while flange 14 engages within, and interlocks with, an outwardly facing flange of an adjacent building pan. As shown in FIG. 11, each interlocked pair of flanges form a stud 30, and a rigid wall 32 includes a plurality of studs 30.

Figure 3:
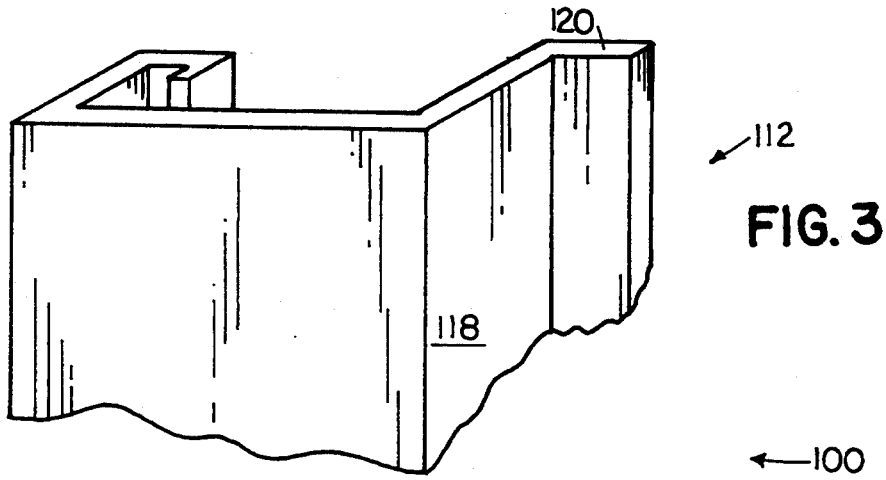
FIG. 3 is an enlarged scale, partial perspective view of an alternate embodiment of a typical wall panel of the present invention.
Figure 4:
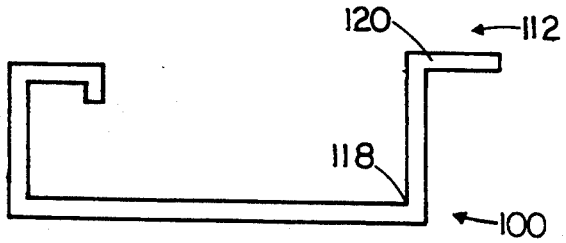
FIG. 4 is an enlarged scale, top plan view of the typical wall panel shown in FIG. 3.

FIGS. 3 and 4 depict a typical building pan 100 with a dimension compensating flange 112. This flange 112 is substantially L-shaped and it includes a base 118 and a transverse portion 120. It does not, however, include a return portion similar to portion 22 of flange 12, shown in FIGS. 1 and 2. When utilized in the modular wall structure 32 of the present invention, building pan 100 compensates for dimensional variations inherent in the respective pans. If not compensated for, these dimensional variations result in excessive stress when a plurality of adjacent building pans are interlocked.

As shown in FIG. 11, dimension compensating flange 112 cooperates with an inwardly facing flange 212 of an adjacent building pan 200. As there is no return portion of flange 112, dimension compensating flange 112 and inwardly facing flange 212 are not rigidly interlocked. Therefore, each of the building pans 100,200 are permitted to slip relative to each other until dimensional excess or shortcomings are compensated for. Once the flanges 112,212 are properly positioned, building pans 100,200 are then interlocked by affixing a return portion to flange 112. This return portion is affixed, by welding or other suitable means, to transverse portion 120, referenced in FIGS. 3 and 4.

Also shown in FIG. 11, is a variety of configurations of the building pans. The present invention, however, is not limited to the building pans shown in the figure. In addition to the building pans illustrated in the figures, building pans could be configured to have either two outwardly facing flanges or two inwardly facing flanges, such as building pan 200 in FIGS. 5 and 6. Additionally, any of the outwardly facing flanges of any of the building pans could be fabricated to be dimension compensating.

Figure 5:
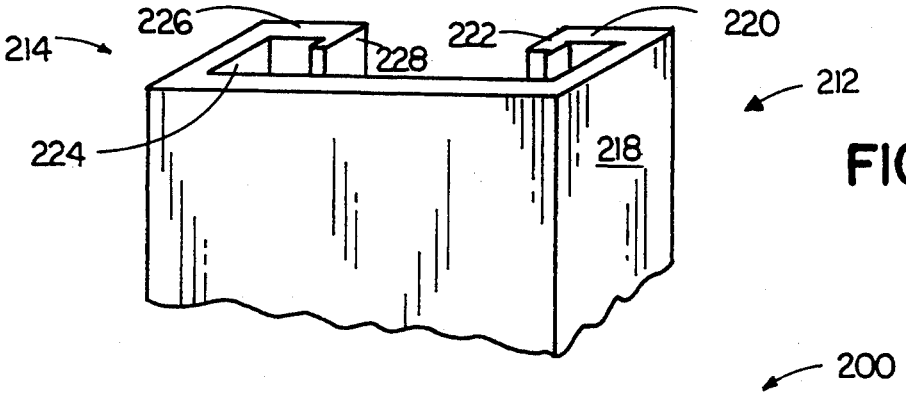
FIG. 5 is an enlarged scale, partial perspective view of a closure panel of the present invention.
Figure 6:
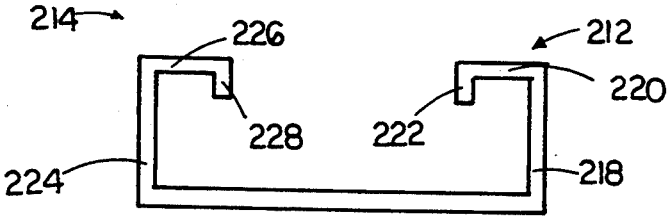
FIG. 6 is an enlarged scale, top plan view of the closure panel shown in FIG. 5.

Building pan 200 of FIGS. 5 and 6 is a closure panel that is shown in the wall structure 32 of FIG. 11. Building pan 200 is capable of interlocking with two adjacent flanges, each of which face outward from their respective main bodies. Referring to FIGS. 5 and 6, flanges 212,214 of building pan 200 include bases 218,224 transverse portions 220,226 and return portions 222,228. As shown in FIG. 11, flanges 212,214 of closure panel 200 mate with outwardly facing flanges 112,414 respectively. Flanges 214,414 are shown to be interlocked, while flange 212 is shown to engage dimension compensating flange 112.

Figure 7:
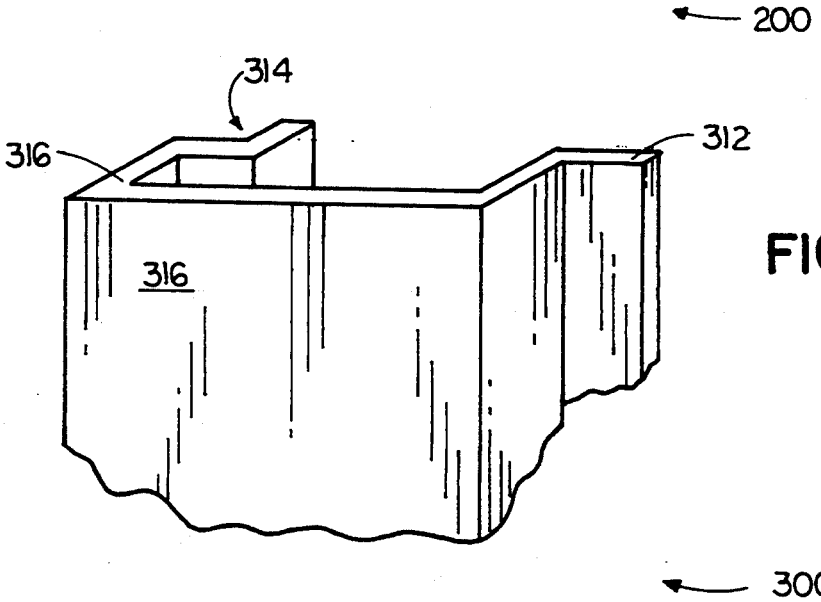
FIG. 7 is an enlarged scale, partial perspective view of a corner panel of the present invention.
Figure 8:
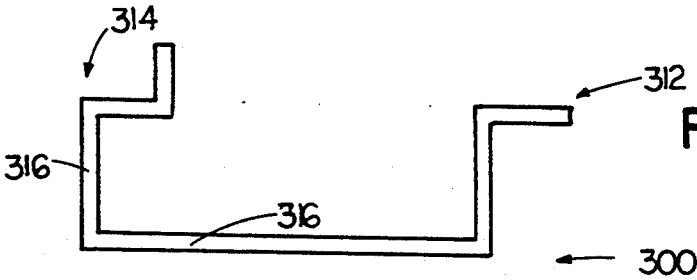
FIG. 8 is an enlarged scale, top plan view of the corner panel shown in FIG. 7.

FIGS. 7 and 8 illustrate a building pan 300 with a bent or angled main body 316. This enables modular wall structure 32 to turn a corner or bend at a given angle. In FIGS. 7 and 8, building pan 300 is illustrated with a pair of dimension compensating flanges 312,314, while in FIG. 11, a similar building pan 500 is illustrated having a pair of interlocking, and not dimension compensating, flanges 512,514.

A foam insulating material 34 is placed on the interior surface of the main body of each building pan. Although insulating material 34 is shown in FIG. 11 to be more concentrated in some areas than in other areas, the most effective insulation is that which is applied evenly to each building pan. The depicted insulation in FIG. 11 is for illustrative purposes only.

One effective method of supplying an insulated material 34 to the plurality of building pans is to spray the material 34 onto the interior surface of each building pan while the plurality of building pans is resting flat on the floor. Materials suitable for insulation 34 include expanded polystyrenes, polyisocyanurates, polyurethanes, and mineral fibers.

Figure 10:
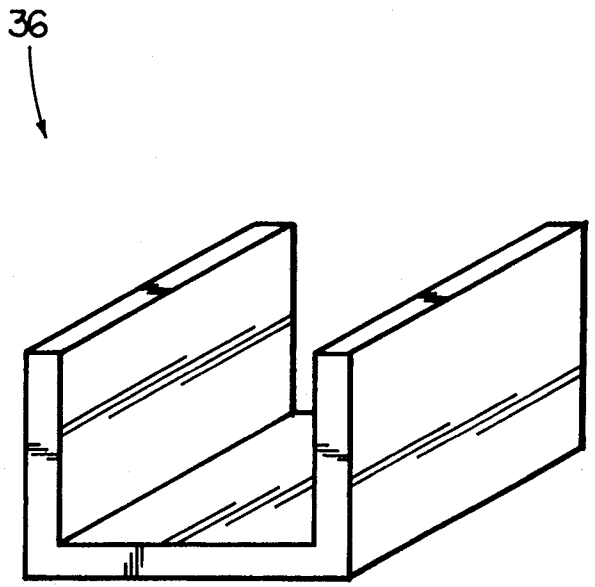
FIG. 10 is an enlarged scale, perspective view of a runner panel of the present invention.
Figure 12:
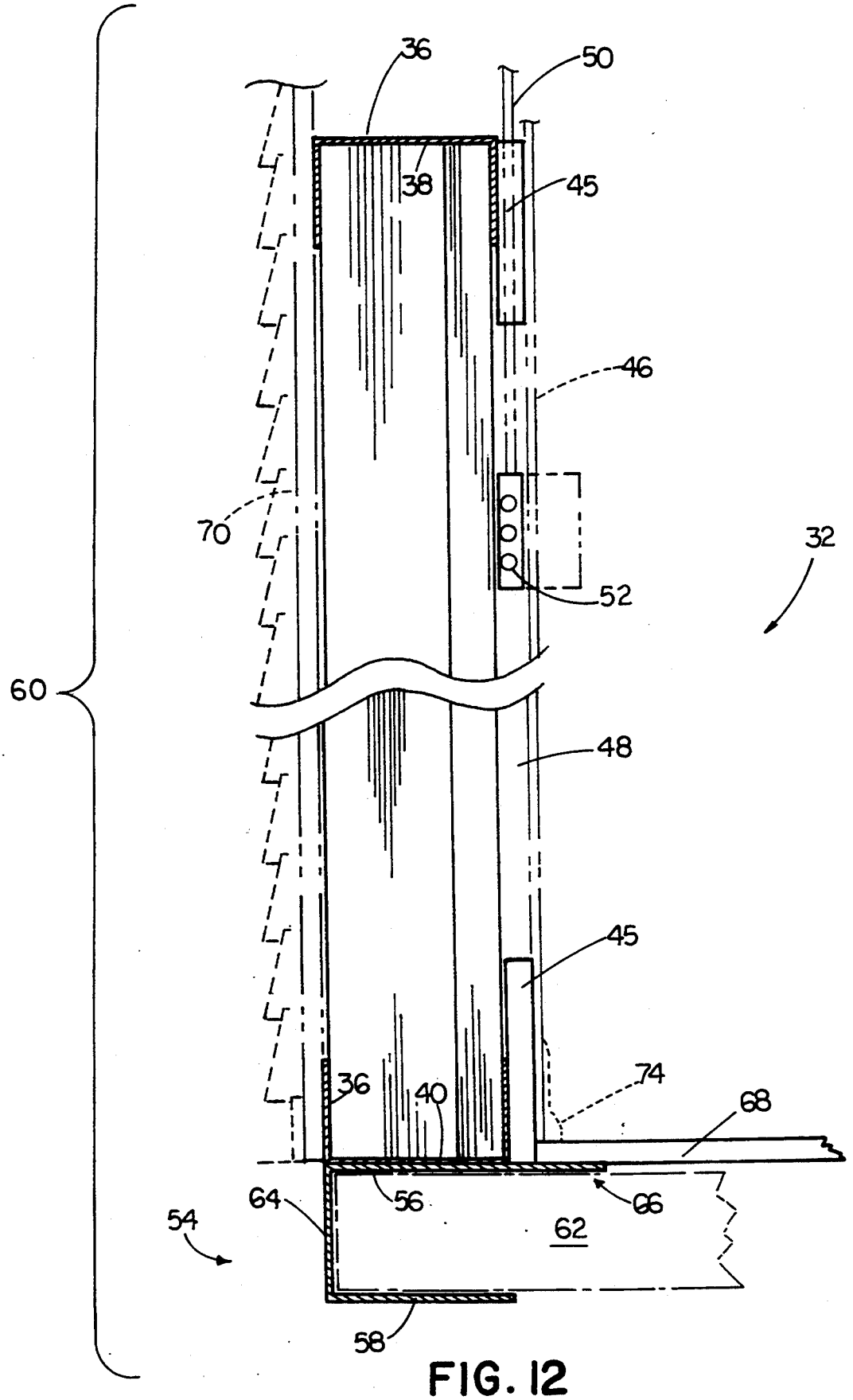
FIG. 12 is a partial side elevational view in cross section, of the modular wall system of the present invention.
Figure 13:
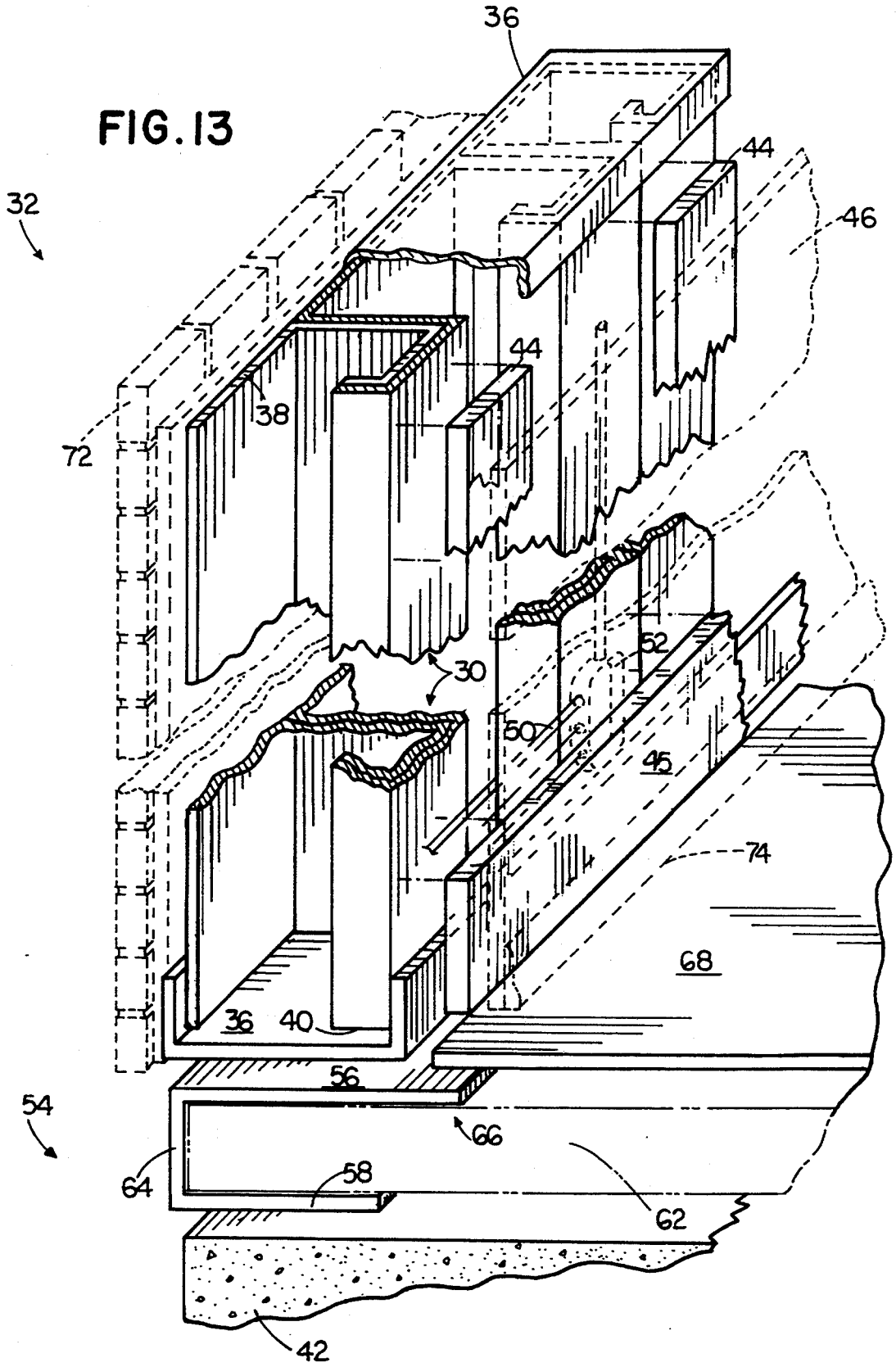
FIG. 13 is a partial perspective, exploded view in cross-section of the modular wall system of the present invention.

Illustrated in FIGS. 11 through 13, is a runner 36 secured to the upper surface 38 of the plurality of interlocked building pans. Runner 36, which is individually depicted in FIG. 10, is fabricated from galvanized steel and is to receive and transfer loads to the structural building pans. A similar runner 36 is secured to the bottom surface 40 of the plurality of interlocked building pans. This runner is for receiving loads from the structural building pans, and for transferring these loads to such surfaces as the foundation 42, shown in FIG. 13.

A plurality of spacers 44,45 are positioned between the studs 30 and the interior wall finish 46 of the building. The purpose of these spacers 44,45 is to create a gap 48 just behind interior wall finish 46. This gap 48 is for placement of such items as electrical wires 50 and electrical boxes 52, as shown in FIGS. 12 and 13. Depending upon the design requirements of the building, spacers 44,45 could be secured to any one of the studs 30, or to any of the runners 36.

In FIGS. 11 and 13, vertical spacers 44 are shown to be proximate to upper surface 38. Although these vertical spacers 44 could be configured to extend to bottom surface 40, they are truncated wherever it is necessary to permit for the passage of electrical wires 50 and the like.

To increase the stability of interior wall finish 46, one or more horizontal spacers 45 could be utilized. In FIG. 13, a horizontal spacer 45 is depicted to extend the length of the runner 36 positioned at bottom surface 40. As this spacer 45 covers the area between adjacent studs 30, it minimizes the likelihood that interior wall finish 46 will bow between the studs 30.

To further increase the stability of interior wall finish 46, additional horizontal spacers could be included. A particularly stable arrangement is shown in FIG. 12. Here, one horizontal spacer 45 is proximate to bottom surface 40, and a similar horizontal spacer 45 is proximate to upper surface 38. If desired, vertical spacers 44 could be positioned between each horizontal spacer 45.

Figure 9:
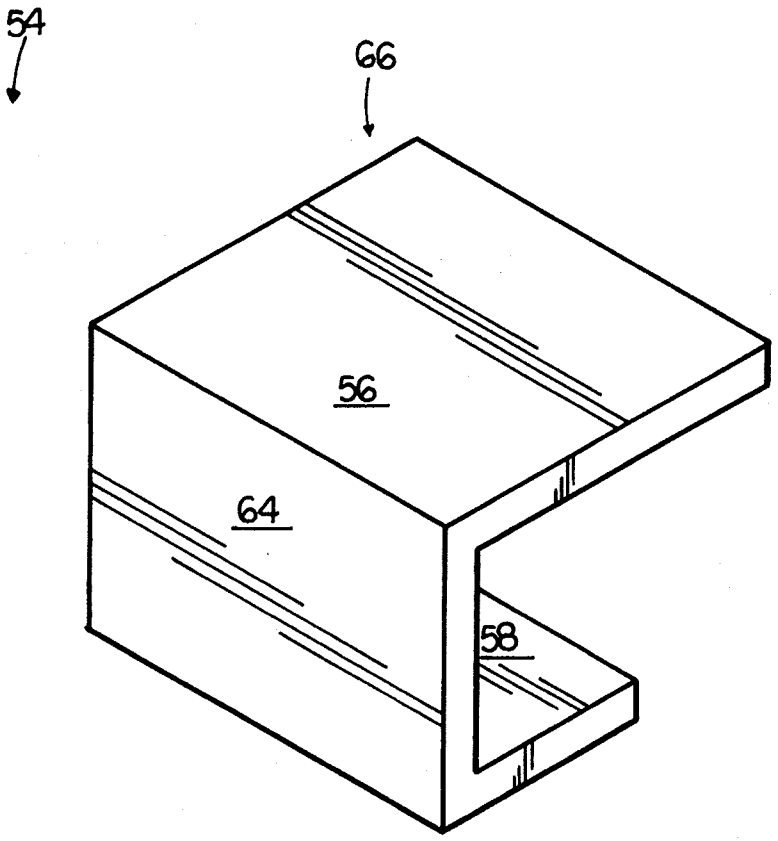
FIG. 9 is an enlarged scale, perspective view of a bearing channel of the present invention.

The rigid wall structure 32 is supported upon a bearing channel 54, which is separately illustrated in FIG. 9. The top plate 56 of bearing channel 54 supports rigid wall 32, and the bottom plate 58 is secured to foundation 42 or the like. When a building of more than one story is to be constructed, the entire structure 60, disclosed in FIG. 12, is repeated vertically until the desired number of stories is achieved. Stated differently, bottom plate 58 of a an additional bearing channel 54 is secured, by appropriate means, to runner 36 on the upper surface of the building pans 38. A rigid wall 32 is then secured to the top plate 56 of this additional runner 36.

To assure that bearing channel 54 maintains its shape and provides adequate support for rigid wall 32, floor joists 62 are placed between top plate 56 and bottom plate 58 so as to abut the connecting plate 64. This facilitates the laying of floor joists 62, as each floor joist 62 has a channel in which to be placed.

Also of importance is the end portion 66 of top plate 56. This end portion 66 extends beyond the plurality of building pans to provide support for the floor boards 68. As the thickness of top plate 56 is slight, portions of the floor boards 68 not supported by end portion 66 can be affixed directly to floor joists 62 for increased stability.

The exterior and interior finish surfaces could be in any form. In FIG. 12, the exterior surface 70 is siding or the like, while the interior surface 46 is any standard wall board. In FIG. 13, the exterior surface 72 is shown to be brick. In both FIGS. 12 and 13, the reference numeral 74 denotes standard floor molding.

In FIG. 11, the building pan 400 is shown to include a cut-out section 425 for a factory created window. Before adding insulation 34 to building pan 400, a pair of runners 36 are utilized to frame both the top surface 438 and bottom surface 440 of the window 425. These runners 36 provide a foundation for insulation 34, and prevent such insulation from blocking window 425. A runner 36 is not necessary at side 442 because this side 442 abuts a stud 30. If side 442 were not at a stud 30, an additional runner 36 would be necessary. Although not shown, appropriate cut-outs can be made for doorways or any other similar structure. If desired, each cut out can be constructed to span the length of numerous building pans.

It is to be understood that the present invention is not limited to the embodiments described above, but encompasses any and all embodiments within the scope of the following claims.

We claim:

1. A modular wall structure comprising:

(A) a plurality of pan members, each pan member of said plurality of pan members comprising:
  a main body with an interior surface; and
  a pair of side elements, each side element of said pair of side elements being dimensioned and configured to interlock with a side element of an adjacent pan member to form a plurality of studs;

(B) an insulating material disposed upon said interior surface of said main body; and (C) at least one spacer positioned adjacent to at least one stud of said plurality of studs, said at least one spacer for securing an interior finished wall thereto.

2. The modular wall structure in accordance with claim 1, further including a bearing channel having a top plate for supporting said plurality of pan members.

3. The modular wall structure in accordance with claim 2, wherein said top plate includes an end portion extending beyond said plurality of pan members, said end portion being configured and arranged for supporting floor boards.

4. The modular wall structure in accordance with claim 2, wherein said bearing channel further comprises a bottom plate for supporting floor joists.

5. The modular wall structure in accordance with claim 1, wherein said pair of side elements of at least one of said pan members, comprises first and second flanges arranged on opposed sides of said main body, each of said first and second flanges having a base, a transverse portion, and a return portion, each of said first and second flanges being substantially J-shaped, said first flange facing outward from said main body and said second flange facing inward to said main body, said first flange being dimensioned and configured to engage over and interlock with an inwardly facing flange of an adjacent pan member.

6. The modular wall structure in accordance with claim 1, wherein said pair of side elements of at least one of said pan members, comprises first and second flanges arranged on opposed sides of said main body, each of said first and second flanges having a base, a transverse portion, and a return portion, each of said first and second flanges being substantially J-shaped, both of said first and second flanges facing inward to said main body, said first and second flanges being dimensioned and configured to individually engage within and interlock with an outwardly facing flange of an adjacent pan member.

7. The modular wall structure in accordance with claim 1, wherein said pair of side elements of at least one of said pan members, comprises first and second flanges arranged on opposed sides of said main body, each of said first and second flanges having a base, a transverse portion, and a return portion, each of said first and second flanges being substantially J-shaped, both of said first and second flanges facing outward from said main body, said first and second flanges being dimensioned and configured to individually engage over and interlock with an inwardly facing flange of an adjacent pan member.

8. The modular wall structure in accordance with claim 1, wherein said pair of side elements of at least one of said pan members comprises a dimension compensating flange having a base and a transverse portion, said dimension compensating flange being substantially L-shaped and facing outward from said main body, said dimension compensating flange being dimensioned and configured to engage over an inwardly facing flange of an adjacent pan member, a return portion attachable to said transverse portion, said transverse portion being of sufficient length to permit attachment of said return portion to interlock said dimension compensating flange with said inwardly facing flange of an adjacent pan member.

9. The modular wall structure in accordance with claim 1, wherein said main body of at least one of said pan members is bent, thereby permitting the interlocking of two adjacent panels arranged in an angular relationship.

10. The modular wall structure in accordance with claim 1, wherein said plurality of pan members have top surfaces, with said modular wall structure further comprising a runner extending across said top surfaces of said plurality of pan members.

11. The modular wall structure in accordance with claim 1, wherein said plurality of pan members have bottom surfaces, with said modular wall structure further comprising a runner extending across said bottom surfaces of said plurality of pan members.

12. A modular wall structure comprising:

(A) a plurality of pan members, each pan member of said plurality of pan members comprising:
a main body with an interior surface; and
a pair of side elements, each side element of said pair of side elements being dimensioned and configured to interlock with a side element of an adjacent pan member to form a plurality of studs;

(B) an insulating material disposed upon said interior surface of said main body; and (C) a bearing channel having a top plate, a bottom plate, and a connecting plate therebetween, said top plate for supporting said plurality of pan members, said top plate having an end portion extending beyond said plurality of pan members, said end portion for supporting floor boards, said bottom plate for supporting floor joists.

13. The modular wall structure in accordance with claim 12, further comprising at least one spacer positioned adjacent to at least one stud of said plurality of studs, said at least one spacer for securing an interior finish wall thereto.

14. The modular wall structure in accordance with claim 12, wherein said pair of side elements of at least one of said pan members, comprises first and second flanges arranged on opposed sides of said main body, each of said first and second flanges having a base, a transverse portion, and a return portion, each of said first and second flanges being substantially J-shaped, said first flange facing outward from said main body and said second flange facing inward to said main body, said first flange being dimensioned and configured to engage over and interlock with an inwardly facing flange of an adjacent pan member.

15. The modular wall structure in accordance with claim 12, wherein said pair of side elements of at least one of said pan members, comprises first and second flanges arranged on opposed sides of said main body, each of said first and second flanges having a base, a transverse portion, and a return portion, each of said first and second flanges being substantially J-shaped, both of said first and second flanges facing inward to said main body, said first and second flanges being dimensioned and configured to individually engage within and interlock with an outwardly facing flange of an adjacent pan member.

16. The modular wall structure in accordance with claim 12, wherein said pair of side elements of at least one of said pan members, comprises first and second flanges arranged on opposed sides of said main body, each of said first and second flanges having a base, a transverse portion, and a return portion, each of said first and second flanges being substantially J-shaped, both of said first and second flanges facing outward from said main body, said first and second flanges being dimensioned and configured to individually engage over and interlock with an inwardly facing flange of an adjacent pan member.

17. The modular wall structure in accordance with claim 12, wherein said pair of side elements of at least one of said pan members, comprises a dimension compensating flange having a base and a transverse portion, said dimension compensating flange being substantially L-shaped and facing outward from said main body, said dimension compensating flange being dimensioned and configured to engage over an inwardly facing flange of an adjacent pan member, said transverse portion being of sufficient length to permit subsequent attachment of a return portion to interlock said dimension compensating flange with said inwardly facing flange of an adjacent pan member.

18. The modular wall structure in accordance with claim 12, wherein said main body of at least one of said pan members is bent, thereby permitting the interlocking of two adjacent panels arranged in an angular relationship.

19. The modular wall structure in accordance with claim 12, wherein said plurality of pan members have top surfaces, with said modular wall structure further comprising a runner extending across said top surfaces of said plurality of pan members.

20. The modular wall structure in accordance with claim 12, wherein said plurality of pan members have bottom surfaces, with said modular wall structure further comprising a runner extending across said bottom surfaces of said plurality of pan members.

21. A method of erecting a modular wall structure, comprising the steps of:

providing a bearing channel having a top plate, a bottom plate, and a connection plate therebetween;

erecting a rigid wall upon said top plate, there being an end portion of said top plate extending outward from said rigid wall;

securing floor joists upon said bottom plate, underneath said top plate; and affixing floor boards upon said end portion of said top plate.

22. The method in accordance with claim 21, wherein said rigid wall is fabricated according to the steps of:

providing a plurality of pan members with each having a configuration providing a main body with at least one flange, said at least one flange having a base, a transverse portion, and a return portion, wherein said at least one flange is substantially J-shaped, and said at least one flange is dimensioned and configured to interlock with a flange of an adjacent pan member;

arranging said plurality of pan members so that said at least one flange may be interlocked with an adjacent flange;

interlocking said plurality of pan members to form a wall element, said wall element having a top surface, a bottom surface, an interior surface and a plurality of spaced studs formed by said interlocking adjacent flanges;

covering said interior surface with an insulating material;

securing a runner to the top surface of said wall element;

securing a runner to the bottom surface of said wall element;

affixing at least one spacer adjacent to at least one stud of said plurality of studs; and providing an interior wall finish to said at least one spacer.

23. The method in accordance with claim 22, further including the step of placing a dimension compensating pan member between two pan members of said plurality of pan members, said dimension compensating pan member having a dimension compensating flange with a base and a transverse portion, said dimension compensating flange being substantially L-shaped and facing outward from said main body, said dimension compensating flange being dimensioned and configured to engage over a flange of an adjacent pan member, said transverse portion being of sufficient length to permit attachment of a return portion to interlock said dimension compensating flange with said inwardly facing flange of the adjacent pan member, said dimension compensating flange being interlocked subsequent to the interlocking of all other adjacent flanges.

24. A method of erecting a modular wall structure, comprising the steps of:

providing a plurality of pan members having potentially mating flanges, with each of said plurality of pan members having a configuration providing a main body with at least one flange, said at least one flange having a base, a transverse portion, and a return portion, wherein said at least one flange is substantially J-shaped, and said at least one flange is dimensioned and configured to interlock with a flange of an adjacent pan member;

including at least one dimension compensating pan member in said plurality of pan members, said at least one dimension compensating pan member having at least one dimension compensating flange with a base and a transverse portion, said at least one dimension compensating flange being substantially L-shaped and facing outward from said main body, said at least one dimension compensating flange being dimensioned and configured to engage over a flange of an adjacent pan member;

arranging said plurality of pan members so that said potentially mating flanges are arranged adjacent to each other; and interlocking all adjacent flanges, said interlocking of said at least one dimension compensating flange being subsequent to said interlocking of all other adjacent flanges, said interlocking of said at least one dimension compensating flange includes attaching said return portion to said at least one dimension compensating flange, all of said interlocked flanges forming a wall element having a top surface, a bottom surface, an interior surface and a plurality of spaced studs formed by interlocking adjacent flanges.

25. The method according to claim 24, further including the steps of:

covering said interior surface with an insulating material;

securing a runner to the top surface of said wall element;

securing a runner to the bottom surface of said wall element;

affixing at least one spacer adjacent to at least one stud of said plurality of studs; and providing an interior wall finish to said at least one spacer.

* * * * *